United States Patent [19]

Amancharla et al.

[11] 3,999,604

[45] Dec. 28, 1976

[54] ROTATION RELEASE TWO-WAY WELL CASING HANGER

[75] Inventors: Amareswar Amancharla, Plano; Carter R. Young, Lewisville, both of Tex.

[73] Assignee: Otis Engineering Corporation, Dallas, Tex.

[22] Filed: July 21, 1975

[21] Appl. No.: 597,449

[52] U.S. Cl. ..... 166/206; 166/214

[51] Int. Cl.[2] ..... E21B 43/10

[58] Field of Search ..... 166/134, 136, 208, 214, 166/216

[56] References Cited

UNITED STATES PATENTS

| | | | |
|---|---|---|---|
| 2,871,947 | 2/1959 | Fredd | 166/214 |
| 3,105,556 | 10/1963 | Raulins | 166/214 |
| 3,507,329 | 4/1970 | Stone, Jr. | 166/214 |
| 3,543,847 | 11/1958 | Haeber | 166/208 |

*Primary Examiner*—James A. Leppink
*Attorney, Agent, or Firm*—Warren H. Kintzinger

[57] ABSTRACT

A well casing hanger for suspending a string of tubing from an outer casing landing nipple, with the hanger structure automatically engaging the nipple structure and latched to a locked state withstanding either suspended weight or upward pull in tension. Hanger structure release is provided by rotation of a member operating a threaded coupling on the upper end of the hanger-operating mandrel through providing a recess to accommodate internal lugs of locking keys so they can be cammed inwardly and unlocked with lifting upward movement of the hanger structure from the landing nipple.

18 Claims, 7 Drawing Figures

ROTATION RELEASE TWO-WAY WELL CASING HANGER

Figure 1:
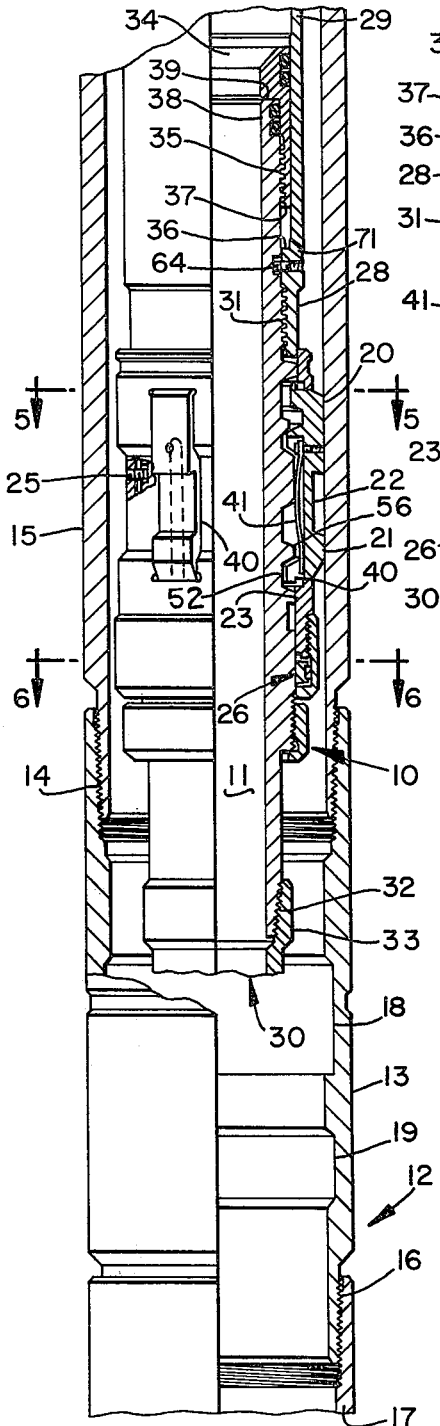

This invention relates in general to well casing hangers for suspending tubing strings from an outer casing landing nipple, and in particular to an improved rotationrelease well casing hanger capable of withstanding both suspended weight and upwardpulling tension forces.

In drilling for the recovery of oil and/or gas, the well hole customarily is lined with concentric pipes called casing strings, in many instances suspended from the top of the well. One example of pre-existing well casing hangers is that of the Samuel W. Putch U.S. Pat. No. 3,420,308; another is the Otis Engineering Corporation Type LO Otis Casing Hanger, illustrated on page 3415 of the Otis 1972–73 Catalog (OEC-5055). These preexisting casing hangers are used to move excessive weight off the wellhead equipment and down the hole. The weight of a second casing may be distributed between the surface equipment and the casing hanger, with most of the weight generally placed on the casing hanger. Savings may be realized by calculating a casing string from the point of the casing hanger installation, instead of from the surface. With many of the wells drilled on offshore locations, it is desirable to support the casing strings at the ocean floor, advantageously using the earth's lateral and vertical support. This method is much safer than support from the water's surface that leaves the casing susceptible to loss or damage from water tide, storm action, and/or ship collision. With many existing casing hangers and well installations, if a well tubing installation is struck by a passing ship, the upper portion of the well casing string may be pushed over; then, with continued ship movement, casing hanger key housing and tubing below the hanger may be pulled out and packers that are set lower in the well may be released, by just this accidental picking-up action, with packer collapse such that the well could blow wild. Such a climactic sequence of events should be prevented if possible, by using a casing hanger that locks into position when the key structure is landed in place in its landing nipple, so the well casing thereabove in water, only bend to the side, without hanger structure and suspended casing therebelow, pulling out.

Casing hangers of the hook-wall type, having slips with teeth that bite into the inner wall of casing, present problems with casing generally-rather-thin wall, of not exact internal diameter, and not presenting an ideal inner surface. The casing inner wall may be corroded and/or covered with scale, and may have glazed areas too smooth and hard for the slips to bite properly. The slips may be dragged along casing wall and their teeth dulled, making questionable how much loading such a hanger device will sustain. By using casing hangers that use landing nipples, the nipple walls can be relatively thick, and good, solid landing shoulders can be provided to support the load. Wide keys may be employed for supporting the load on prepared nipple landing shoulders that may be hard and glazed for more positive operation in supporting up to in the hundreds of thousands of pounds. Further, at various times it is desirable to be able to selectively unlock and remove casing hanger structures and suspended casing for well servicing, tubing and equipment salvage, and/or deeper extended drilling to lower zones, or for developing other production areas through present well outer casing.

It is therefore a principal object of this invention to provide a two-way well casing hanger capable of withstanding either suspended weight or upward pull in tension.

Another object with such a two-way well casing hanger is to achieve a latched to a locked state ensuring that the casing hanger structure be held in the state capable of withstanding either suspended weight or upward pull in tension.

A further object is to provide for selective unlocking release of the casing hanger structure for withdrawal of hanger structure and suspended tubing only when desired.

Another object is to provide a casing hanger that locks from movement in either direction, merely by letting down on the casing hanger when it has seated in a nipple.

Features of this invention useful in accomplishing the above objects include, in a rotation-release two-way well casing hanger, a well casing hanger latched to an engaged locked state in which the hanger will withstand either weight or upward tension. A plurality of spring-biased keys come to registry in a landing nipple, as assisted with weight of suspended tubing transmitted to the keys via an angled shoulder on the main mandrel providing a radial outward component of axial-suspended tubing load, forcing the keys into the nipple. Once landed in a receiving nipple, the keys are locked in place through sliding of a mandrel boss into position radially under the keys. A snap ring structure engages a groove on the main mandrel, locking the hanger housing from longitudinal movement relative to the mandrel, and transferring any upward force on the mandrel through the snap ring structure to the keys, and thereby to the landing nipple. The hanger structure is releasable by rotation of the mandrel, through tubing from above, to operate a threaded coupling at the upper end of the mandrel-to create an external recess accommodating an internal lug of each of the keys, that are thereby permitted to be cammed, radially inwardly, with upward lifting movement of the mandrel and hanger housing, with the keys, from the landing nipple.

A specific embodiment representing what is presently regarded as the best mode for carrying out the invention is illustrated in the accompanying drawings.

Figure 2:
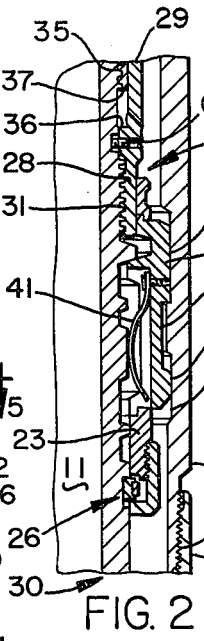
Figure 3:
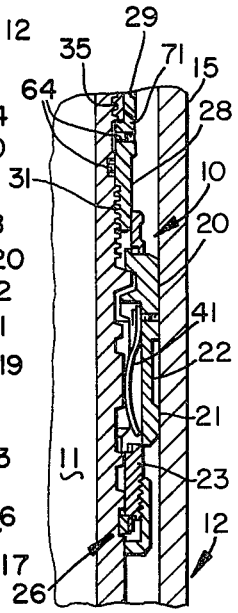
Figure 5:
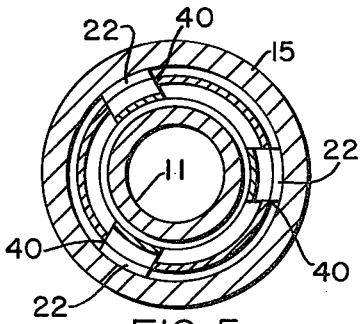
Figure 6:
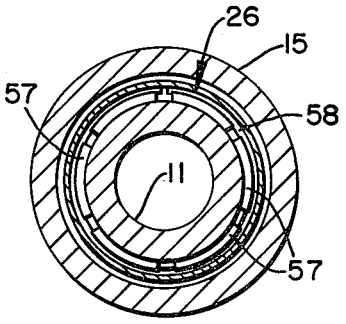
Figure 4:
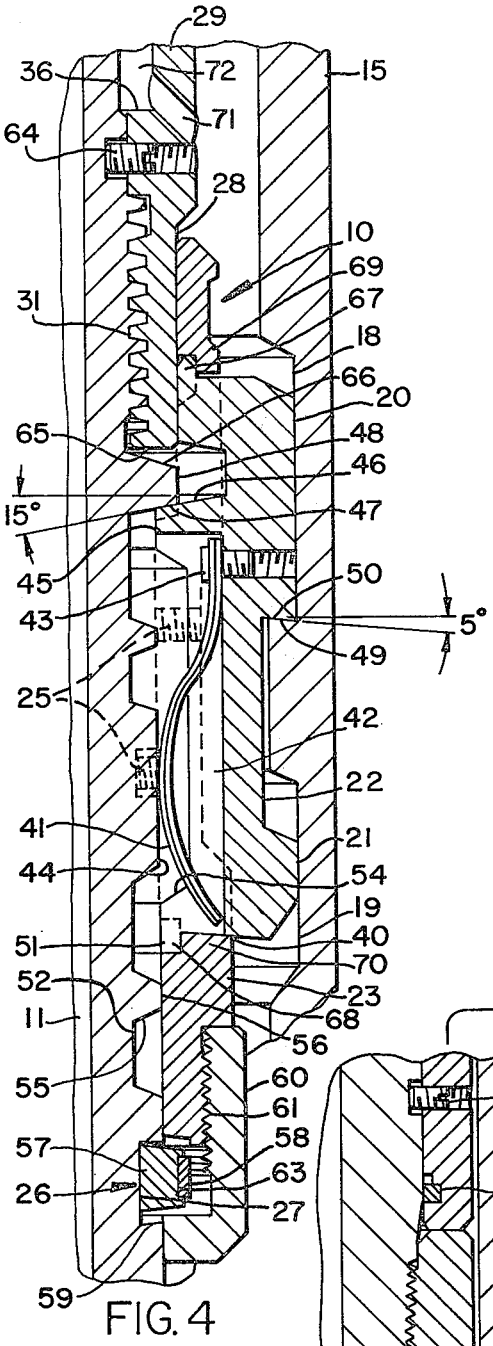
Figure 7:
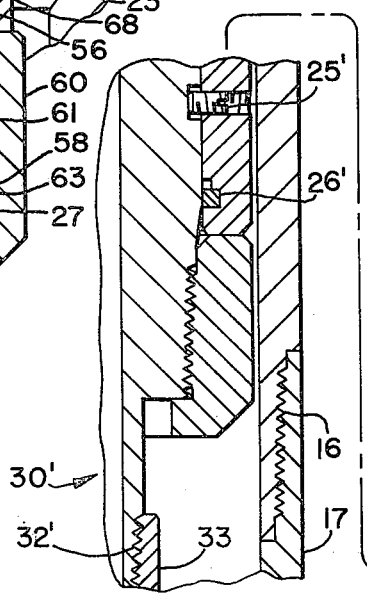
Figure 7:
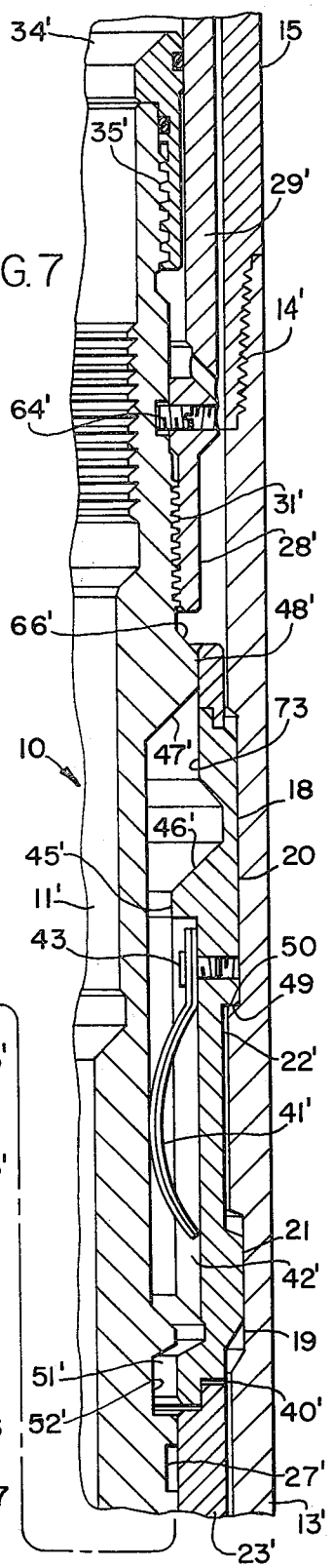

In the drawings:

FIG. 1 represents a side elevation view, with portions of outer well casing broken away and sectioned to show casing hanger detail, and exposing the casing hanger key housing that is further broken away and sectioned to show key housing, key, mandrel, and locking release detail, with hanger key housing and mandrel in running position above its landing nipple;

FIG. 2, a partial side elevation view of half of the rotation release casing hanger of FIG. 1, in the landed and set mandrel locked position;

FIG. 3, a partial side elevation view of half of the rotation release casing hanger key housing and mandrel, in the released state, raised in outer casing from its landing nipple;

FIG. 4, a partial side elevation, enlarged, view of a section of FIG. 2, showing larger detail of the rotation release casing hanger in the landed and set mandrel locked position;

FIG. 5, a view, in section, along line 5—5 of FIG. 1, showing outer casing, key, casing hanger key housing, and locking mandrel detail;

FIG. 6, a view, in section, along line 6—6 of FIG. 1, showing detail of a multi-segment snap ring structure in the casing hanger key housing; and, FIG. 7, an alternate embodiment partial side elevation view of a half of casing hanger key housing, key, and mandrel, shown with keys landed but not locked.

Referring to the drawings:

The casing hanger structure 10 supported on mandrel 11 within outer casing string 12 is shown in FIG. 1 to be above and approaching its landing nipple 13, included as part of the outer casing string 12, as a first casing string. The landing nipple 13, of generally conventional construction, is assembled and run with the outer casing string 12, with a threaded connection 14 to upper casing 15, and a threaded connection 16 to lower casing 17. Annular recesses 18 and 19 within the landing nipple 13 are profiled to receive the sizing and spacing of projections 20 and 21, respectively, of the keys 22 held by casing hanger key housing 23.

Casing hanger key housing 23 is an annular housing that carries a plurality of keys 22, three in the embodiment of FIGS. 1–6. The housing 23 is mounted for a relative movement shift on casing mandrel 11, when shear screws 25 are sheared after landing of keys 22 in nipple 13, with movement of the mandrel 11 down through the housing 23 from the position shown in the running-in state of FIG. 1, to the nipple 13 landed and locked state of FIGS. 2 and 4, with the mandrel 11 moved down until the snap ring unit 26 is seated in snap ring groove 27 in the mandrel. In this position, the lower key locking end 28 of upper casing sub 29 is shifted into key locking position radially under the upper end of keys 22. The mandrel 11 is made up in a second casing string 30, with a rotation lock release threaded connection 31 within lower key locking end 28 of upper casing sub 29, and with a threaded connection 32 within the upper end of lower casing sub 33. A rotation release limit position cap 34, having a threaded connection 35 with the top of the mandrel 11, has opposite turn threads to the rotation release threads of mandrel threaded connection 31, to provide a positive lock stop of upper casing sub 29 internal shoulder 36 with the bottom end 37 of cap 34 when the cap 34 is fully threaded in place with internal shoulder 38 seated on the upper end 39 of mandrel 11. With the rotation lock release threaded connection 31 being left hand threads, the threaded connection 35 uses right hand threads. Obviously, these could be reversed as long as they are reverse hand threads.

The keys 22 are spring-loaded keys, guided in windows 40 of casing hanger key housing 23 for radially outward and inward movement as biased and resisted by longitudinally extended leaf-type springs 41, individually contained within slots 42 of individual keys 22. Spring mounting screws 43 each mount a spring 41 within a key slot 42 to resiliently reactively press against annular shoulder 44 of mandrel 11 in urging the respective keys 22, outwardly. Generally, keys 22 are of standard construction, except for the key underside projections such as projection 45 of each key 22 that is formed with a 15° angled upper face 46 that is subject to downward, weight-supporting, engagement with similarly 15° angled matching lower face 47 of annular hanger boss 48. This condition comes about after the keys 22 have been resiliently biased outwardly by springs 41 and after the shear screws 25 (when more than one is used) have been sheared subsequent to the bottom shoulder 49 of key upper projection 20 having landed on landing shoulder 50 of annular recess 18 in the landing nipple 13. Underside projection 51 at the lower end of each key 22 projects into annular groove 52 of mandrel 11, with the casing hanger structure 10 in the running state of FIG. 1, with upper angled projection face 54 engageable with downward-facing, angled-face 55 of annular mandrel boss 56, in a no-go limit. Thus, projection 45 and/or projection 51 limit longitudinal movement of the keys 22 and, thereby, casing hanger structure 10, relative to mandrel 11, and help prevent untimely shearing of shear screws 25 with the keys 22 and/or key housing 23 engaging scale or other obstruction when being run in the outer casing string 12 as shown in FIG. 1. Then, when the casing hanger structure 10 encounters a landing nipple 13 of the right type, keys 22 expand outwardly as permitted by the nipple recesses, and bottom shoulders 49 of key projections 20 land on nipple landing shoulder 50. The faces of key shoulder 49 and nipple landing shoulder may be hardened and glazed as well as sloped, such as at a 5° angle, as indicated in FIG. 4, for good, reliable landing and operational service life. After the casing hanger structure 10 is located in the nipple 13, and keys 22 have landed, application of, for example, 20,000 to 30,000 (according to size) pounds of set-down weight is applied to the mandrel 11 to shear the shear screws 25 that, along with the no-go state of the key inner projections and mandrel bosses, have been holding the mandrel 11 and housing 23 in the running-in state of FIG. 1. With the keys 22 expanded outwardly in the nipple 13, and the no-go relation of key projections and mandrel bosses no longer exists, the shearing of shear screws 25 may occur with relative longitudinal downward movement of mandrel 11, within key housing 23, as urged by set-down weight applied to the mandrel 11. While shear screws 25 are loaded to shear stress, supporting contact of the tops of landed keys 22 with the tops of housing windows 40 resists further downward movement of the housing 23. After shearing of the screws 25, mandrel 11 moves down until segments 57, retained by spring ring 58 of snap ring unit 26, seat in snap ring groove 27 in the mandrel 11. Referring to FIGS. 2, 4, and, also, 6, there are six segments 57 having 5° angled sides that help keep them in the groove 27, particularly with the groove having a mating 5° angled bottom wall 59. When the mandrel 11 has been moved to the snap ring unit 26, groove 27 engaged state, the lower key-locking end 28 of upper casing sub 29, as effectively an extension of mandrel 11, has been moved to the locking position, radially under the upper ends of keys 22. This effectively locks the casing hanger structure 10 and mandrel 11 in place, locked in the landing nipple 13. Any upward force on mandrel 11 is transferred through the snap ring segments 57, the housing 23, and the keys 22, to the landing nipple 13. Thus, the tubing of the second casing string can be set in tension or compression and, particularly, for offshore completions, accidentaly induced movements of the tubing above the hanger does not release the hanger or packer structure therebelow. The multi-segmented snap ring unit 26 is conveniently enclosed within a retainer cap 60, mounted by a threaded connection 61 on the bottom of casing hanger key housing 23. The segments 57 of the snap ring unit 26 are resiliently urged inwardly by spring ring 58, that is in the form of almost a circle-with a gap between the ends-seated in outer grooves 63 of the arcuate snap ring segments 57.

With the casing hanger structure 10 so locked in place in the landing nipple 13, it cannot be moved out of the nipple in either longitudinal direction, up or down. It can be unlocked only in the following manner: The upper casing sub 29, that is threaded onto the upper end of the mandrell 11 in rotation-release threaded connection 31 and made fast with shear screw (or screws) 64, causes-with the application of sufficient torque to the right (500 foot pounds of torque, for example)-the screws 64 to shear. Continued right-hand-turning torque backs the sub 29, in relative rotation to the mandrel, off, to unscrew the sub, up through some six to ten rotations, until a limit is reached in contact with limit position cap 34. This unscrewing of the sub 29 opens up a recess between the lower end 65 of the sub and the upward facing sloped face 66 of annular hanger boss 48 of mandrel 11. With the lower key locking end 28 of the upper casing sub 29 moved out of the way, the keys 22 are then free to be cammed, inward, and disengage the nipple 13, with upward lifting disengaging movement of the casing hanger structure 10 with the mandrel 11, to the withdrawal state of FIG. 3. Outward movement of keys 22 is limited by upper and lower tab extensions 67 and 68 engagement, respectively, with housing upper and lower shoulders 69 and 70, in establishing an outermost key 22 position, even when the casing hanger structure 10 is not contained within a first casing string. Fluid passage 71 is provided for to-and-from fluid flow from the annular chamber 72, formed between upper casing sub 29, the mandrel 11, and cap 34, to prevent cavity-hydraulicing problems with relative movement of the parts.

In the alternate rotation-release two-way well casing hanger embodiment of FIG. 7, there are many similarities both structurally and operationally with the embodiment of FIGS. 1 through 6; with items the same, or quite similar, being numbered the same or given a primed identification number as a matter of convenience in identifying corresponding parts between the two embodiments. This being true with reference to this embodiment, some of the parts and features will not even be discussed other than just carrying the corresponding number, or primed number, as related to the other embodiment. The casing hanger structure 10' is fixed by shear screws 25' from longitudinal relative movement on the annular mandrel 11' upon which it is carried down through the running state configuration, as shown in FIG. 7, until keys 22' have landed in the landing nipple 13'. Then, with sufficient letdown force, the screws 25' are sheared and the mandrel 11' moves downward through the casing hanger key housing that is held in position, from further downward movement, by the landed keys 22' until snap ring unit 26' -in this instance, a simple, single-element snap ring-comes into alignment with snap ring groove 27' and snaps into the groove, with the mandrel 11' and the key housing 23' thereby locked from material relative longitudinal movement, with respect to each other. The key-locking lower end 28' of upper casing sub 29' is moved into outer key 22' position locking alignment under the inner surface 73 of keys 22', of which there are four in this particular embodiment. When in this state, lower sloped face 47' of the annular hanger boss 48', on the mandrel 11' is in weight-supporting engagement against the angled upper face 46' of key underside projections 45', in fulfilling the casing hanging function. Further, the snap ring unit 26' resists upward lifting forces transmitted thereto from the bottom of snap ring groove 27' with any lifting effort applied to the mandrel 11'. Such upward lifting force is transferred by the snap ring unit 26' to the casing hanger key housing 23' and on through the keys 22' to the landing nipple 13'. With this embodiment, shear screws 25' are located in the structure lower end, out of the key 22' region-unlike the other embodiment, but they do perform essentially the same operational function with the mandrel 11' and casing hanger key housing 23' so locked together, and the casing hanger structure 10' locked in place in the landing nipple 13', that the casing hanger structure 10' simply cannot be moved out of the nipple in either longitudinal direction, up or down. It is subject to being unlocked in only one way, quite similar to that of the other embodiment; which is, to apply torque to the upper casing sub 29', in the direction that would unscrew the sub, sufficient to shear the shear screws 64' and to unscrew the sub through some approximately six rotations, until the limit contact with rotation release limit position cap 34' is reached. This unscrewing of the sub 29' opens a recess between the lower end of the sub and the upward-facing, sloped face 66' of annular hanger boss 48' of mandrel 11'. Then, with the lower key-locking end 28' of the upper casing sub moved out of the way, the keys 22' are free to be cammed inward and disengage nipple 13' with continued upward lifting disengaging movement of the casing hanger structure 10', along with the mandrel 11', to the withdrawal state.

Whereas this invention is here illustrated and described with respect to two particular embodiments thereof, it should be realized that various changes may be made without departing from essential contributions to the art made by the teachings hereof.

We claim:

1. In a two-way well casing hanger adapted for suspending a string of tubing within outer casing from a landing nipple in the outer casing string, and capable of resisting both downward loading forces and upward lifting forces: key means adapted for landing in a landing nipple included in said outer casing string; key housing means holding said key means; mandrel means adapted for being part of said string of tubing, and constructed for carrying said key housing means, and said key means in a running state as the key housing means is subject to being lowered within said outer casing string; relative longitudinal movement-limiting means, limiting relative movement between said mandrel means and said housing means; spring means resiliently urging separation of said key means from said mandrel means for moving said key means radially outwardly into landed engagement with said landing nipple; locking structure means shiftable for locking said key means in landed engagement with said landing nipple and to resist both upward and downward forces exerted on the mandrel means well casing hanger; said key means and said mandrel means include downward load-carrying mutually engagable boss means between said mandrel means and said key means; said mandrel means being shiftable downward relative to said key housing means, from the relative position thereof, in the running state, to load carrying engagement of said boss means between said mandrel means and said key means; and wherein snap ring means is structured to establish a relative longitudinal shifting limit between said mandrel means and said key housing means; and with said snap ring means positioned to snap into the relative longitudinal shifting limit state as said mandrel is moved to the load-carrying engagement state of said boss means between said mandrel means and said key means, with said key means landed in a landing nipple.

2. The casing hanger of claim 1, wherein said relative longitudinal movement-limiting means, including no-go shoulder-engaging means between said key means and said mandrel means, are subject to no-go mutual engagement when said mandrel means, said key housing means, and said key means are in said running state before landing of said key means in said landing nipple.

3. The casing hanger of claim 2, wherein said locking structure means, shiftable for locking said key means in landed engagement with a landing nipple, includes shoulder means, longitudinally moveable with said mandrel, relative to said key housing means when said key means is moved radially outward, relative to said mandrel means, upon key means landing in a nipple, out of no-go shoulder means no-go engaging alignment; and with said shoulder means moveable to a position radially behind said key means when the key means is in a radially outward landing nipple landed state.

4. The casing hanger of claim 3, wherein said longitudinal movement-limiting means also includes shearable key housing means-to-mandrel means interconnect means.

5. The casing hanger of claim 4, wherein said shearable key housing means-to-mandrel means interconnect means is shearable by letdown weight applied to said mandrel when said key means has landed in a landing nipple.

6. The casing hanger of claim 5, wherein said key means is a plurality of keys, each urged radially outwardly by individual resilient spring means confined between each of said keys and said mandrel means.

7. The casing hanger of claim 6, wherein each of said keys is supported and guided for radially inward and outward movement in key windows of said key housing means.

8. The casing hanger of claim 7, wherein said locking means is a tubular lock member threaded onto the top of said mandrel means as, effectively, an extension of said mandrel means.

9. The casing hanger of claim 8, wherein said tubular lock member may be rotation-release turn threaded back to an unlock position, withdrawing the shoulder means from locking position radially behind said key means to permit camming inward of said key means from the landed-in-a-nipple state, and removal upward with lifting force applied to said mandrel means, the key housing means, and the keys.

10. The casing hanger of claim 9, wherein shear member interconnect means is provided, interconnecting said tubular lock member and said mandrel means.

11. The casing hanger of claim 10, wherein rotation-release turn limit position means is mounted on said mandrel.

12. In a casing hanger for use in wells having an outer casing including at least one landing nipple: key means adapted for landing engagement with a landing nipple in a well casing; mandrel means; lock means shiftable into locking position behind said key means when said key means is landed in a landing nipple, to lock said casing hanger in landing nipple engagement from relative movement downward, with downward loading forces, and from relative movement upward, with upward lifting forces applied to the mandrel means; and wherein said lock means is threaded to said mandrel means and is rotation-releasable to an unlocked position state.

13. The casing hanger of claim 12, with rotation-release position-limit position means.

14. The casing hanger of claim 12, with shear screw interconnect between lock means and said mandrel means.

15. The casing hanger of claim 12, with said key means a plurality of keys; and with the keys held in windows of a hanger casing housing in circumferential alignment and balanced spacing about said mandrel means.

16. A two-way well casing hanger structure for suspending a string of tubing from an outer casing landing nipple and capable of resisting both downward loading forces and upward lifting forces, having: landing nipple means with annular recess means, runable as part of a first casing string; key means, profiled to cooperatively engage and land in said landing nipple means; key housing means holding said key means; mandrel means includable as part of a second casing string and constructed for carrying said key housing means in a running state as the key housing is being lowered within said first casing string toward said landing nipple means; relative longitudinal-movement-limiting means, limiting relative movement between said mandrel means and said key housing means; spring means resiliently urging separation of said key means from said mandrel means for moving said key means outward into landed engagement with said landing nipple means; locking structure means positionable for locking said key means in landed engagement with said landing nipple means to resist both upward and downward mandrel means and key housing means movement forces; and wherein said locking structure means, shiftable for locking said key means in landed engagement with a landing nipple, includes shoulder means, longitudinally moveable with said mandrel, relative to said key housing means when said key means is moved radially outward, relative to said mandrel means, upon key means landing in a nipple, out of no-go shoulder means no-go engaging alignment; and with said shoulder means moveable to a position radially behind said key means when the key means is in a radially outward landing nipple landed state.

17. The casing hanger of claim 16, wherein said locking structure means is a tubular lock member threaded onto the top of said mandrel means as, effectively, an extension of said mandrel means.

18. The casing hanger of claim 17, wherein said tubular lock member may be rotation-release turn threaded back to an unlock position, withdrawing the shoulder means from locking position radially behind said key means to permit camming inward of said key means from the landed-in-a-nipple state, and removal upward with lifting force applied to said mandrel means, the key housing means, and the keys.

* * * * *